US005584179A

United States Patent [19]

Isa

[11] Patent Number: 5,584,179

[45] Date of Patent: Dec. 17, 1996

[54] PUMPING MACHINE AND GENERATOR SYSTEM UTILIZING THE SAME

[75] Inventor: Shinei Isa, 455-25 Nagura-ootawara, Ishigaki-shi, Okinawa-ken, Japan

[73] Assignees: Endo, Katsuhisa, Tochigi-ken; Isa, Shinei, Ishigaki, both of Japan

[21] Appl. No.: 212,941

[22] Filed: Mar. 15, 1994

[30] Foreign Application Priority Data

| | | | |
|---|---|---|---|
| Mar. 15, 1993 | [JP] | Japan | 5-080059 |
| Sep. 13, 1993 | [JP] | Japan | 5-251097 |
| Dec. 15, 1993 | [JP] | Japan | 5-342888 |

[51] Int. Cl.[6] ..... F16D 31/02

[52] U.S. Cl. ..... 60/370; 60/398; 417/122

[58] Field of Search ..... 60/370, 371, 375, 60/376, 398; 415/916; 417/122

[56] References Cited

U.S. PATENT DOCUMENTS

| | | | |
|---|---|---|---|
| 847,358 | 3/1907 | Obear et al. | 417/122 |
| 987,679 | 3/1911 | Miller | 417/122 |
| 3,925,984 | 12/1975 | Holleyman | 60/370 |
| 4,426,846 | 1/1984 | Bailey | 60/398 |

FOREIGN PATENT DOCUMENTS 3133387 3/1983 Germany .

*Primary Examiner*—F. Daniel Lopez
*Attorney, Agent, or Firm*—Oblon, Spivak, McClelland, Maier & Neustadt, P.C.

[57] ABSTRACT

A pumping machine is disclosed which comprises valve means and air intakes, the valve means comprising a plurality of check valves and having a double-layer structure, the valve means being caused to vertically reciprocate by delivery of compressed air, the air intakes being so formed that external air is introduced in mid course of the reciprocating motion of the valve means, wherein external air is introduced in parallel with suction of water to be pumped up in mid course of the reciprocating motion of the valve means, the introduced air is then compressed, and then expansion force of the air generated by releasing the water with air from the pressure is utilized as water pumping force.

9 Claims, 11 Drawing Sheets

FIG. 8A
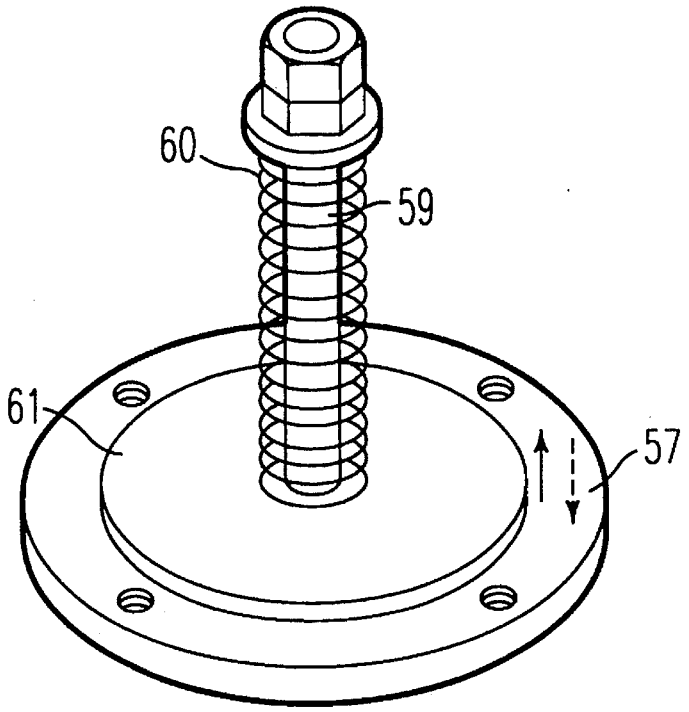
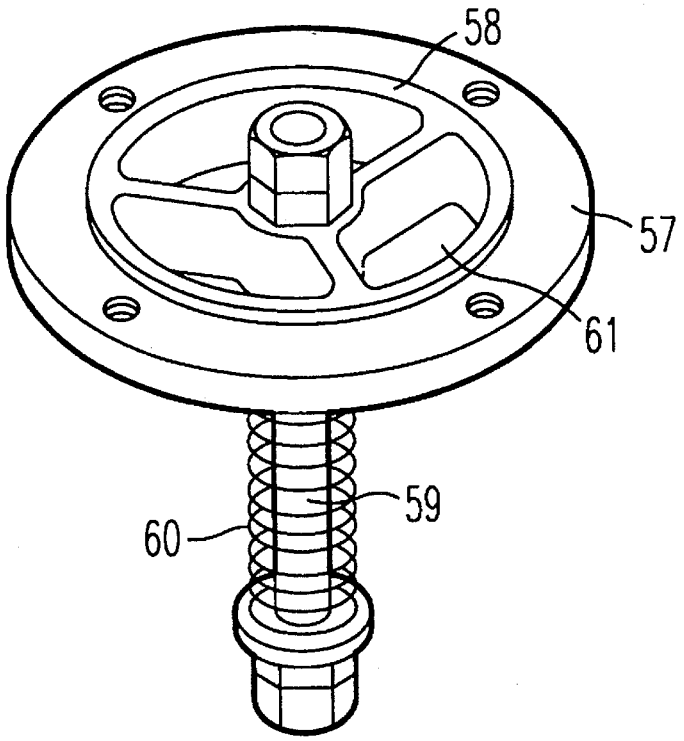
FIG. 8B

PUMPING MACHINE AND GENERATOR SYSTEM UTILIZING THE SAME

BACKGROUND OF THE INVENTION

1. Field of the Invention

The present invention relates to a pumping machine utilizing expansion energy of compressed air and a cylinder for the pumping machine.

2. Discussion of Background

As regards water pumping, there has heretofore been known so-called storage pumps which comprise valve means and a piston reciprocating therebetween and which deliver water in one direction by utilizing the reciprocating motion of the piston to perform water pumping.

However, since these conventional storage pumps deliver water only in one direction by the reciprocating motion of the piston, they require a large amount of energy because of frictional resistance to the piston and resistance to the movement of the water.

SUMMARY OF THE INVENTION

The present inventor has succeeded in enabling sufficient water pumping with extremely low energy consumption, not by simply causing only water to move in one direction, but by bringing air into coexistence with water attendantly upon movement of the water, compressing the air, and then releasing the air from the pressure to generate expansion force simultaneously with discharge of the water to be pumped up.

It is an object of the present invention to provide a pumping machine enabling such highly efficient water pumping and a cylinder preferably used in the pumping machine.

It is a further object of the present invention to provide a power generator system using them. In particular, it is an object of the present invention to provide a highly efficient and energy saving pumping machine and a power generator system utilizing the same by re-pressurizing returned air having a residual pressure into compressed air for supplying to the above-mentioned cylinder.

The present invention includes a pumping machine which comprises valve means comprising a plurality of check valves and having double-layer structure that vertically move by delivery of compressed air, and air intakes for introducing external air in mid course of the reciprocating motion of the valve means.

According to the present invention, there is provided a cylinder for the pumping machine comprising:

a cylindrical hollow body formed with a first through-hole at its mid portion and second and third through-holes in the vicinities of its ends, a cylindrical hollow member which is fitted in said cylindrical body slidably in the longitudinal direction of the cylindrical body and which is formed with a communication opening which is in communication with the first through-hole, valve means mounted on the ends of said cylindrical member, a cylinder member which is contained in said cylindrical member and which has ports in the vicinities of its ends, and a piston member which is slidably disposed in said cylinder member and which has a rod extending through said cylinder member and having its ends fixedly connected to said valve means;

wherein said valve means each include two plates to define a cylinder chamber having a communication opening in communication with said second or third through-hole, said plates each having a plurality of check valves arranged therein, said check valves each being mounted to permit a fluid to flow only in the direction toward the inner portion of said cylinder member.

According to the present invention, there is also provided a generator system disposed under a predetermined water pressure and comprising:

an air cylinder including a piston which reciprocates by switchover between delivery of compressed air to a supply pipe and reception of compressed air from a return pipe, a water cylinder including a water piston which is located coaxially with the piston of the air cylinder and which reciprocates in association with the movement of the piston of the air cylinder, an air intake formed about the middle of said water cylinder for introducing external air into water in a cylinder chamber of said water cylinder by negative pressure generated in the cylinder chamber in the course of the reciprocating motion of said water piston, and an outlet for discharging the mixture of water with air in said cylinder chamber, which has been compressed to a predetermined pressure, by the reciprocating motion of said water piston;

said power generator system further comprising a compressed air boosting compressor including as an air pressure source connected to said return pipe in series:

a low pressure tank for storing air with a residual pressure, a first boosting compressor for sucking the air with a residual pressure from said low pressure tank, an intermediate pressure tank for storing the compressed air discharged from said first boosting compressor and for preventing abrupt change in the pressure, a second boosting compressor for boosting the compressed air with an intermediate pressure from said intermediate pressure tank to a predetermined pressure, a high pressure tank for storing the compressed air discharged from said second boosting compressor and for preventing abrupt change in the pressure, and a receiver tank which is connected to said supply pipe for relaying the compressed air from said high pressure tank to said supply pipe;

each of said first and second boosting compressors being selected from the group consisting of one-stage to multi-stage reciprocating compressors.

As each of said first and second boosting compressors, a two-stage reciprocating compressor is preferred.

By timely controlling the compression and expansion of the air drawn into the cylinder chamber containing water to be pumped up, water pumping is carried out with a small amount of energy by virtue of the expansive action of the compressed air.

In other words, when compressed air is introduced into the cylinder member through one of the ports, the piston is caused to move toward the other port side, and valve means moves concurrently which are adapted to move in association with the piston. By the movement of the valve means, water to be pumped up is caused to flow into the cylinder chamber facing the water storage reservoir for storing water to be pumped up through check valves, and external air is also introduced into the cylinder chamber through the communication opening formed in the chamber. As a result, the air coexists with the water as a mixture in the cylinder chamber. Upon arrival of the valve means at the top dead center, compressed air is supplied through the other port of the cylinder member to cause the valve means to descend.

Further, as a boosting compressor for returned air, one having the above-mentioned structure is used.

Consequently, it is possible that a returned air having a positive residual pressure higher than the atmospheric pressure is stored in the low pressure tank and drawn into the first boosting compressor and compressed therein and then discharged and stored in the intermediate pressure tank and further compressed therein to a predetermined pressure and then stored as a high pressure compressed air and supplied to the supply pipe via the receiver tank as a compressed air supply.

BRIEF DESCRIPTION OF THE DRAWINGS

FIG. 8 is a perspective view generally showing one form of the check valve used for the cylinder for the pumping machine as shown in FIG. 3;

FIG. 12 is a diagrammatic view schematically showing power generation mechanism utilizing the pumping machine comprising a compressed air booster for the pumping machine according to the present invention.

DETAILED DESCRIPTION OF THE PREFERRED EMBODIMENT

The present invention will be described in detail with reference to the preferred embodiments.

It should, however, be understood that the present invention is by no means restricted to the members, arrangements and the like which will specifically be described below, and that various changes and modifications may be made without departing from the spirit and scope of the present invention.

Figure 1:
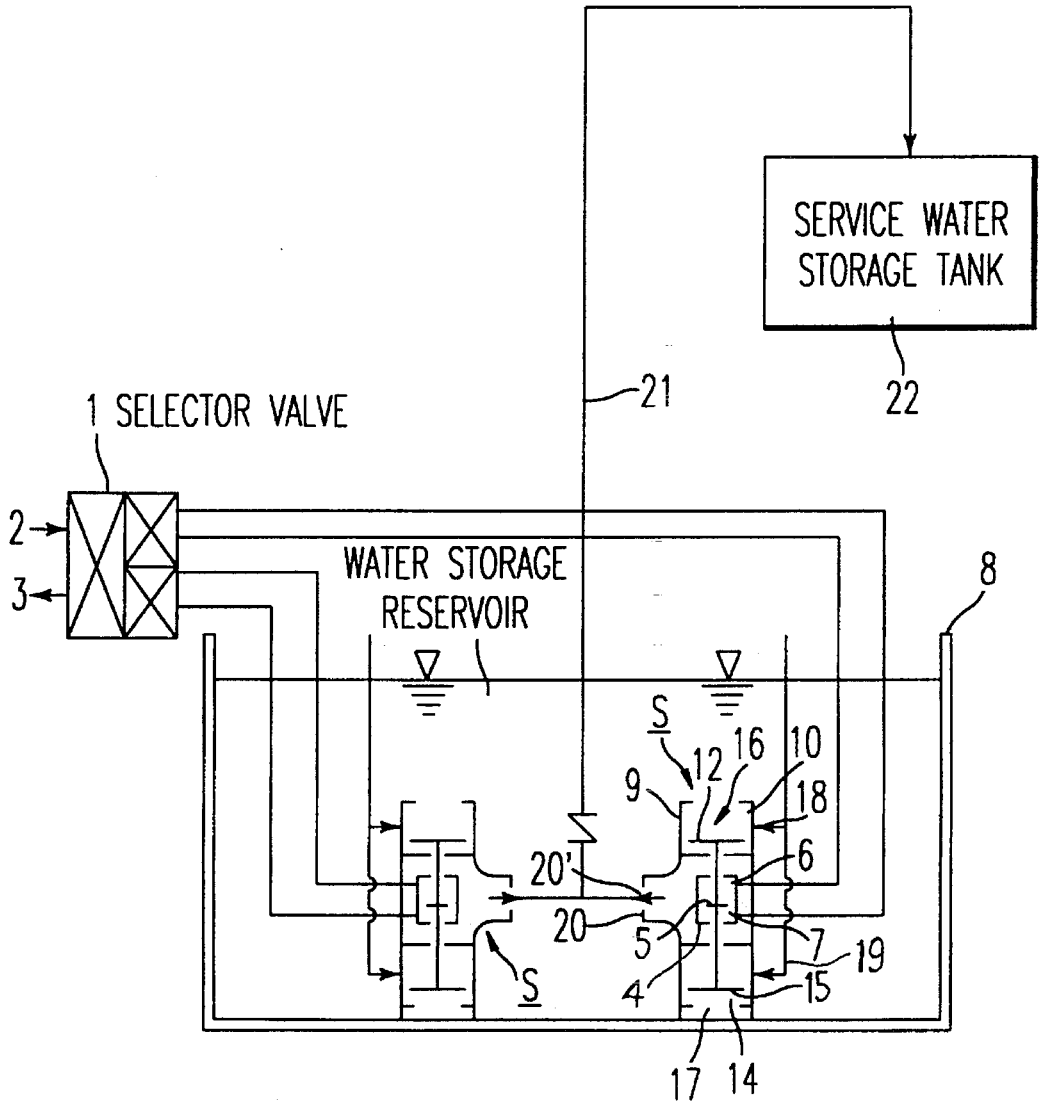
FIG. 1 is a diagrammatic view showing one embodiment of the pumping machine according to the present invention.

FIG. 1 is a diagrammatic view of one embodiment of the present invention schematically showing a water pumping mechanism. Although this embodiment is so constructed that two pumping machines each comprising an air cylinder and pumped-water cylinders are arranged in parallel, air flow and water flow will be described below with respect to only one of the pumping machines for the convenience of explanation.

In FIG. 1, reference numeral 1 represents a selector valve for air, and the selector valve 1 alternately directs compressed air at predetermined time intervals toward one side 6 and the other side 7 of an air cylinder 4 to cause an air piston 5 to reciprocate. The selector valve 1 directs compressed air from a compressed-air pipe 2 toward one side 6 of the air cylinder 4 to cause the air piston 5 to move.

On the other hand, air in the other side 7 of the air cylinder 4 is compressed by the air piston 5 and sent back to the selector valve 1 and returned through an outlet pipe 3 to an accumulator tank (not shown). The compressed air thus returned is directed again to the selector valve 1 via first and second boosters (not shown) and through the compressed-air pipe 2. The selector valve 1 changes air flow after lapse of the predetermined time interval, and directs the air flow toward the other side 7 of the air cylinder 4 to move the air piston 5 to one side 6 of the air cylinder 4. Consequently, air in one side 6 of the air cylinder 4 is discharged therefrom by the air piston 5 and returned through the outlet pipe 3 to the accumulator tank (not shown).

Thus, the compressed air is circulated through the air cycle in the above-mentioned circulatory course, and thereby the piston 5 is caused to move. In this case, a compressed-air pressure of 5 kg/cm$^2$ G, a cylinder diameter of 500 mm, a piston stroke of 250 mm and a piston area of 1918 cm$^2$ are employed. The reciprocating motion of the air piston 5 in the air cylinder 4 is set at 92 reciprocations per minute.

In the next place, a water channel is described.

In FIG. 1, reference number 8 represents a water storage reservoir, and the water storage reservoir 8 has a depth of about 7 m, i.e., it is capable of providing a water pressure corresponding to the water depth of about 7 m. The air piston 5 of the air cylinder 4 is associated with valve means 12 and 15 in water cylinder 9. When the piston 5 is pushed downwardly by supplying the compressed air to one side 6 of the air cylinder 4, the valve means 12 and 15 are also pushed down simultaneously.

Each of the valve means 12 and 15 has a double-layer structure in which, for example, 18 check valves having a diameter of 100 mm are concentrically distributed in each of the layers, i.e., each of the valve means has, for example, 36 check valves in total. The operation of the valve means 12 and 15 is described below with respect to FIGS. 3–9.

In the water channel of this embodiment, each of the cylinders 10 and 14 and the valve means 12 and 15 has a diameter of 1400 mm and each of the valve means 12 and 15 travels a stroke of 250 mm. Midway between the cylinder 10 and the cylinder 14, the outlet 20 is formed and the outlet 20 has a diameter of 300 mm. The air intakes, pipes each have a diameter of 5 inches and include check valves 18 and 19. Those check valves preclude backflow of air and water through the intake pipes. The air intakes are provided at the midpoints of the stroke of the respective valve members 12 and 15, i.e., at the positions of 12.5 cm.

In this embodiment, there are arranged in parallel the two pumping machines each comprising the air cylinder 6,7 having the air piston 5 and the two water cylinders 10 and 14 respectively having the valve members 12 and 15 which move in association with the piston 5. However, there may be used (a) pumping machine(s) in which a single valve member associated with a piston 5 is caused to vertically reciprocate attendantly upon movement of the piston 5 to take in water and to introduce air and the water is pumped up utilizing force of the compressed air. Further, besides the use of the two pumping machines in parallel, a single pumping machine may be used or three or more pumping machines may be used in parallel. Of these arrangements, those in which pumping machines are arranged in parallel and/or in which two valve means are associated with a piston are preferred. The reason for this is that more smooth operation in pumping up water is enabled due to increased number of times of air compression in spite of somewhat complicated valve control.

In this embodiment, the valve means are caused to vertically reciprocate by utilizing compressed air. However, means for the movement of the valve means is restricted to the switchover of the direction of compressed air flow. Other transmission means, for example, an oil pump, a linear motor which readily enables reciprocating motion, or the like may be used.

Figure 2:
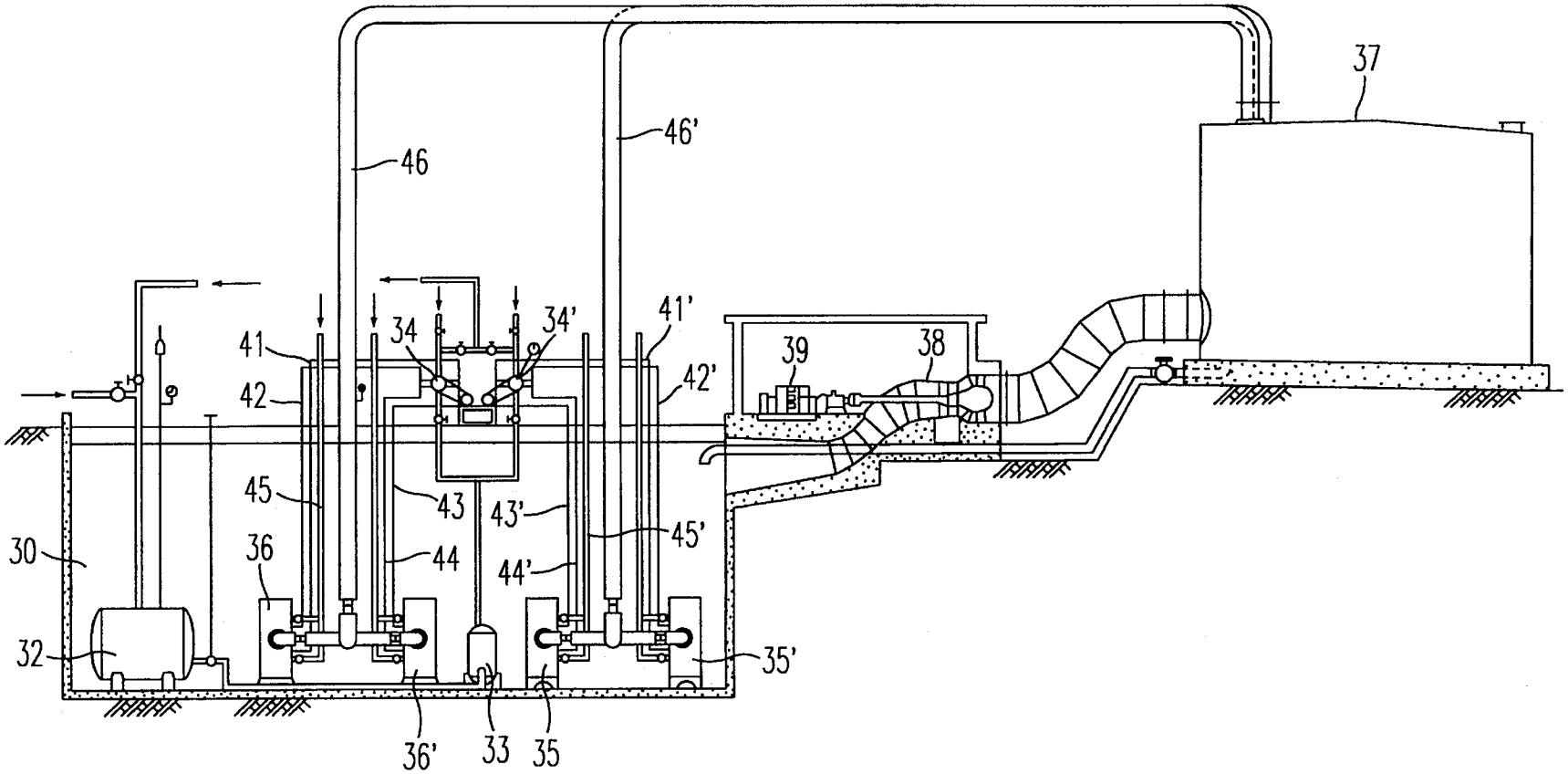
FIG. 2 is a diagrammatic view schematically showing a power generator system which utilizes the pumping machine according to the present invention to generate electric power.

FIG. 2 is a diagrammatic view schematically showing power generation mechanism utilizing a pumping machine as described above.

In FIG. 2, reference numeral 32 represents an accumulator tank, which stores up compressed air from a compressor (not shown). The compressor (not shown) is operated with commercial power. Reference numeral 33 represents an air receiver (relay tank), which transfers the compressed air from the accumulator tank 32 to a selector valves 34,34'.

In the power generator system according to this embodiment, a four port connection-two position rotary selector valve is used, and a KS type motor of 0.75 kw is used as a power for the selector valves 34,34'. The valves 34,34' are so constructed that air released from an air release port (R port) is caused to flow into a collector of a booster circuit (not shown) and boosted in the booster circuit so as to pneumatically force itself to enter into the accumulator tank 32. In this embodiment, each of the two valves 34 and 34' is used to deliver and to receive the compressed air, thereby effecting switchover between delivery and reception of the compressed air.

Reference numerals 35, 35', 36 and 36' represent pumping machines which are those as described above. In the generator system according to this embodiment, these four pumping machines are used. Accordingly, by the switchover between delivery and reception of the compressed air by means of the valves 34,34', pistons in air cylinders of the pumping machines 35, 35', 36, and 36' are alternately caused to reciprocate. In association with the movement of the pistons in the air cylinders, valve means in water cylinders of the pumping machines are caused to reciprocate to pump up water in the water cylinders together with air which has been sucked therein to a service water storage tank 37. The pumped water is stored in the service water storage tank 37 and then released therefrom to drive a water turbine 38 by utilizing a head of the water, thereby operating a power generator 39 to obtain a predetermined generated energy.

Reference numeral 30 represents a water storage reservoir which is provided with the accumulator tank 32, the air receiver 33 and the pumping machines 35, 35', 36 and 36' and which is normally filled with water.

The pumping machines 35, 35', 36 and 36' are provided with inlet and outlet pipes 43' and 44', 41' and 42', 41 and 42, and 43 and 44, respectively, which are connected to the selector valves 34', 34', 34 and 34, respectively, by which switchover between delivery and reception of the compressed air is performed.

To the pumping machines 35, 35' and 36, 36' are connected air intake pipes 45 and 45' for introducing external air, respectively, through which air is brought into coexistence with water in the cylinders as a mixture attendantly upon reciprocating motion of the valve means (not shown) in the pumping machines. By virtue of expansion force of the air coexistent with the water as a mixture, the water is pumped up to the service water storage tank 37 via pumped-water pipes 46' and 46 connected to the pumping machines 35, 35' and 36, 36', respectively.

In this embodiment, a compressor (not shown) is used to obtain compressed air, and the compressed air is temporarily stored in the accumulator tank 32 and then used for the air cylinders and the compressed air used is returned to the accumulator tank 32 for recycling. In case lowering of the pressure takes place in the course of the circulation, an auxiliary pump (not shown) may be attached to the accumulator tank 32 in addition.

In the next place, an embodiment of the cylinder mechanism for the above-described pumping machine will be described.

Figure 3:
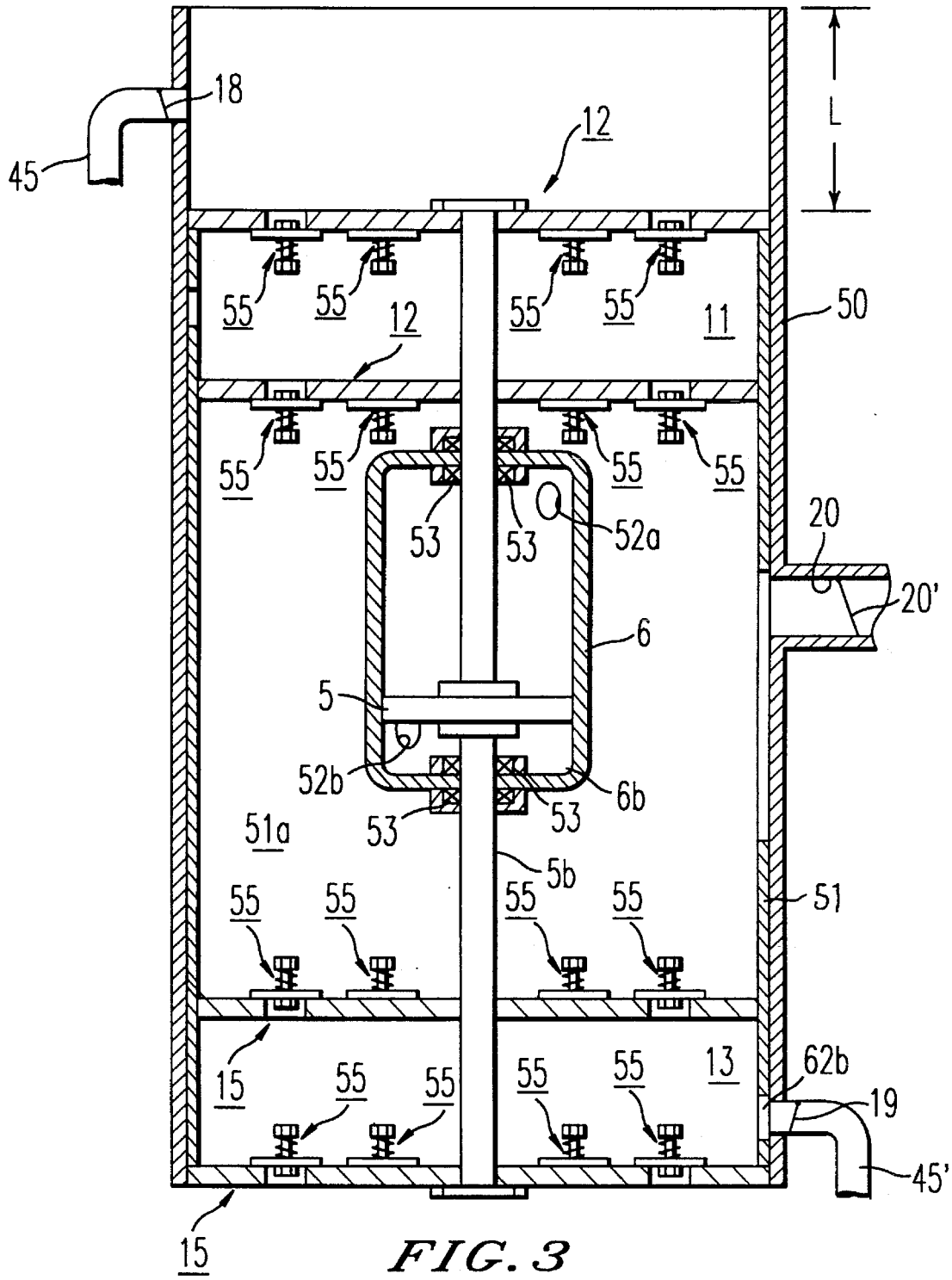
FIG. 3 is a vertical sectional view of one embodiment of the cylinder for the pumping machine according to the present invention, in which valve members of the water cylinder are at the bottom dead centers.
Figure 4:
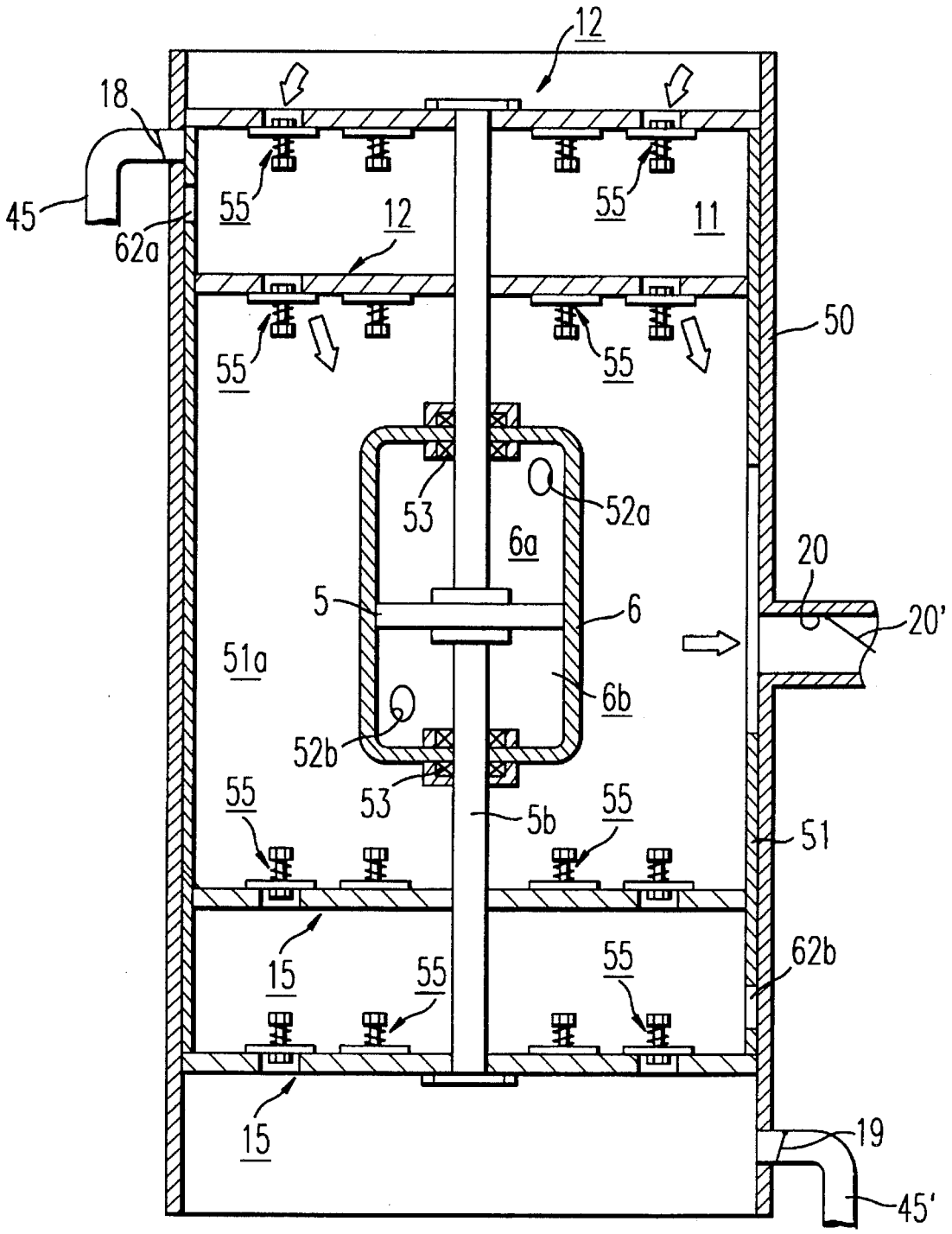
FIG. 4 is a vertical sectional view of the embodiment of the cylinder for the pumping machine according to the present invention, in which the valve members of the water cylinder have somewhat ascended from the bottom dead centers.
Figure 5:
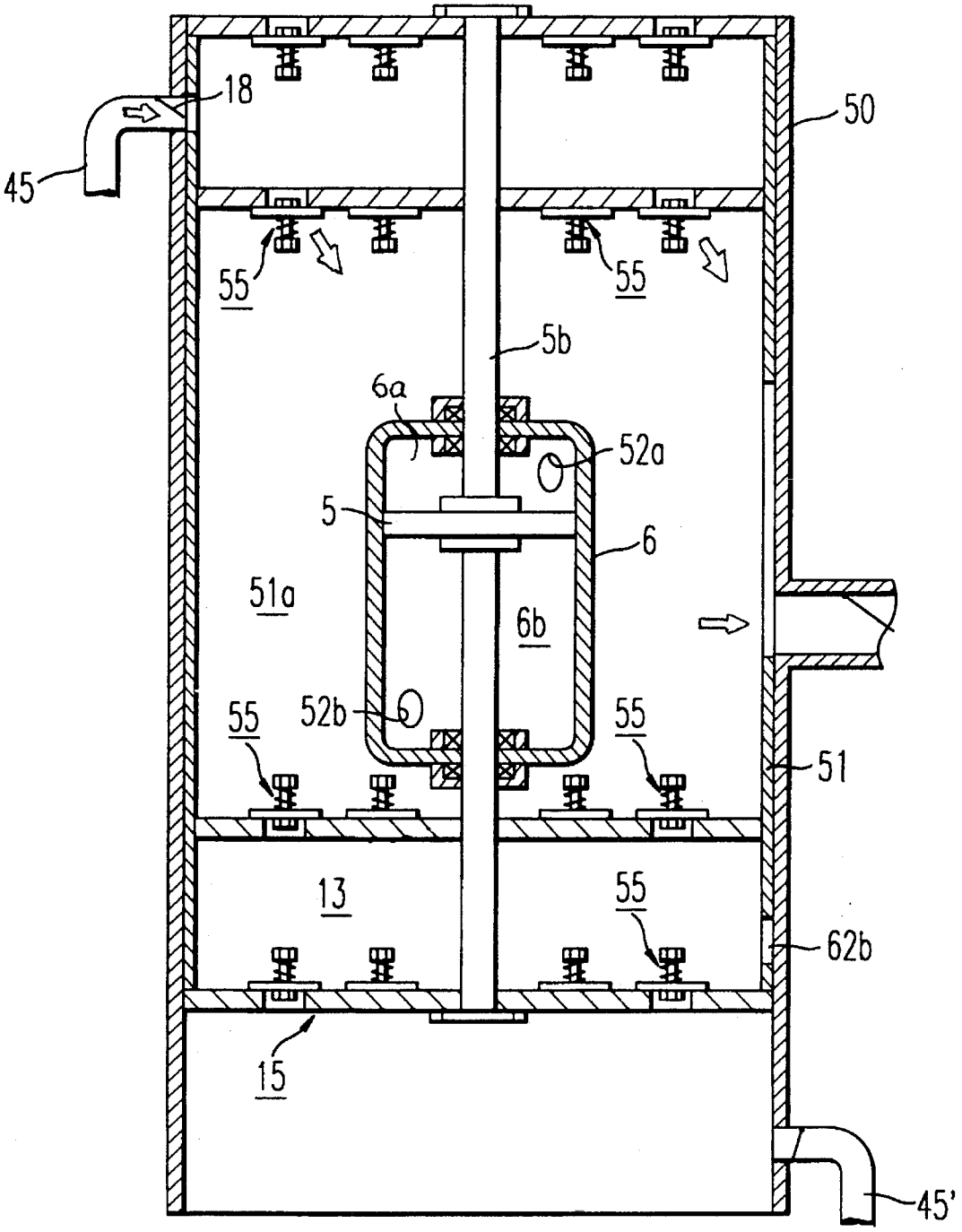
FIG. 5 is a vertical sectional view of the embodiment of the cylinder for the pumping machine according to the present invention, in which the valve members of the water cylinder are at the top dead centers.
Figure 6:
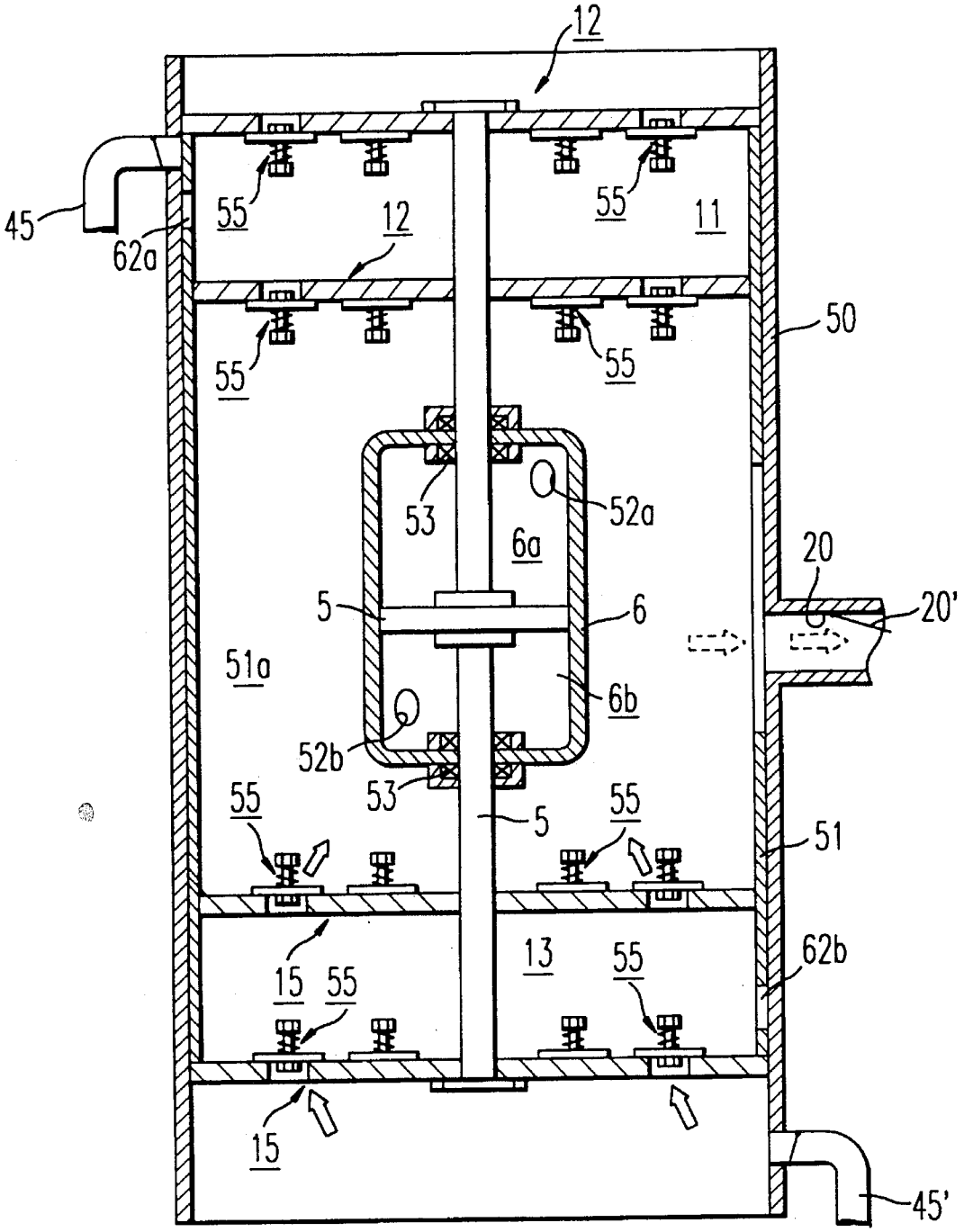
FIG. 6 is a vertical sectional view of the embodiment of the cylinder for the pumping machine according to the present invention, in which the valve members of the water cylinder have somewhat descended from the top dead centers.
Figure 7:
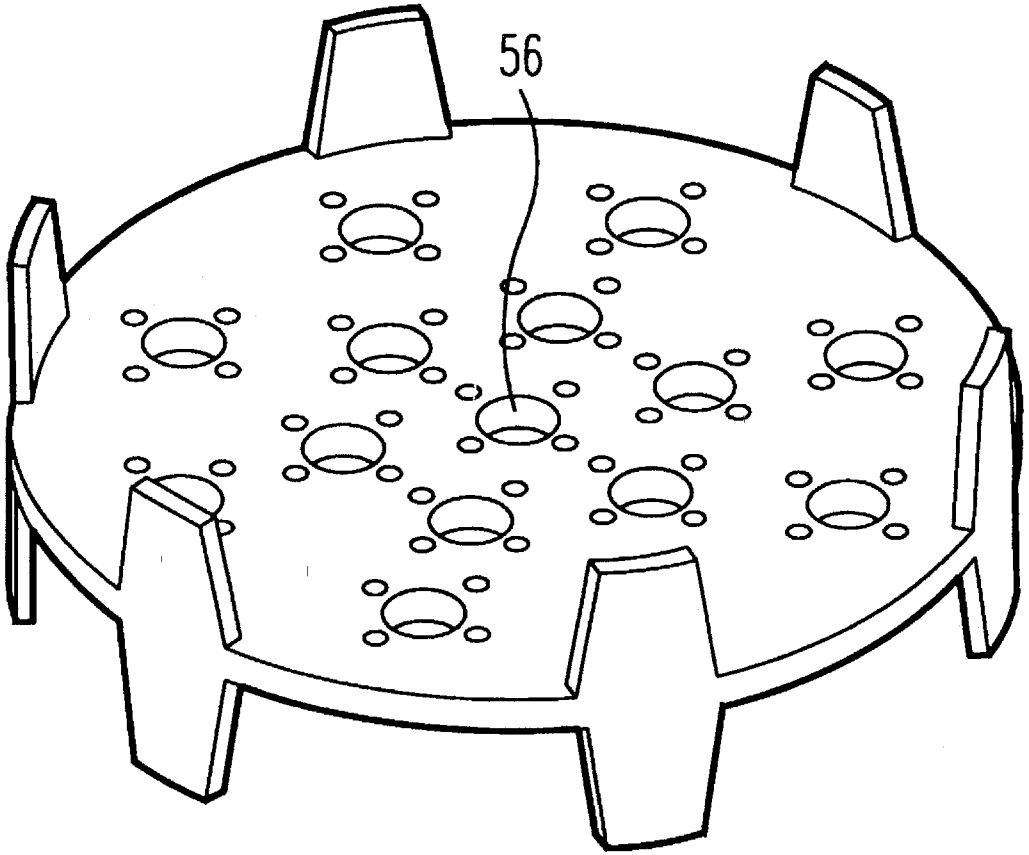
FIG. 7 is a perspective view generally showing one mode of distribution of check valves in a disc member to which check valves are to be attached.
Figure 9:
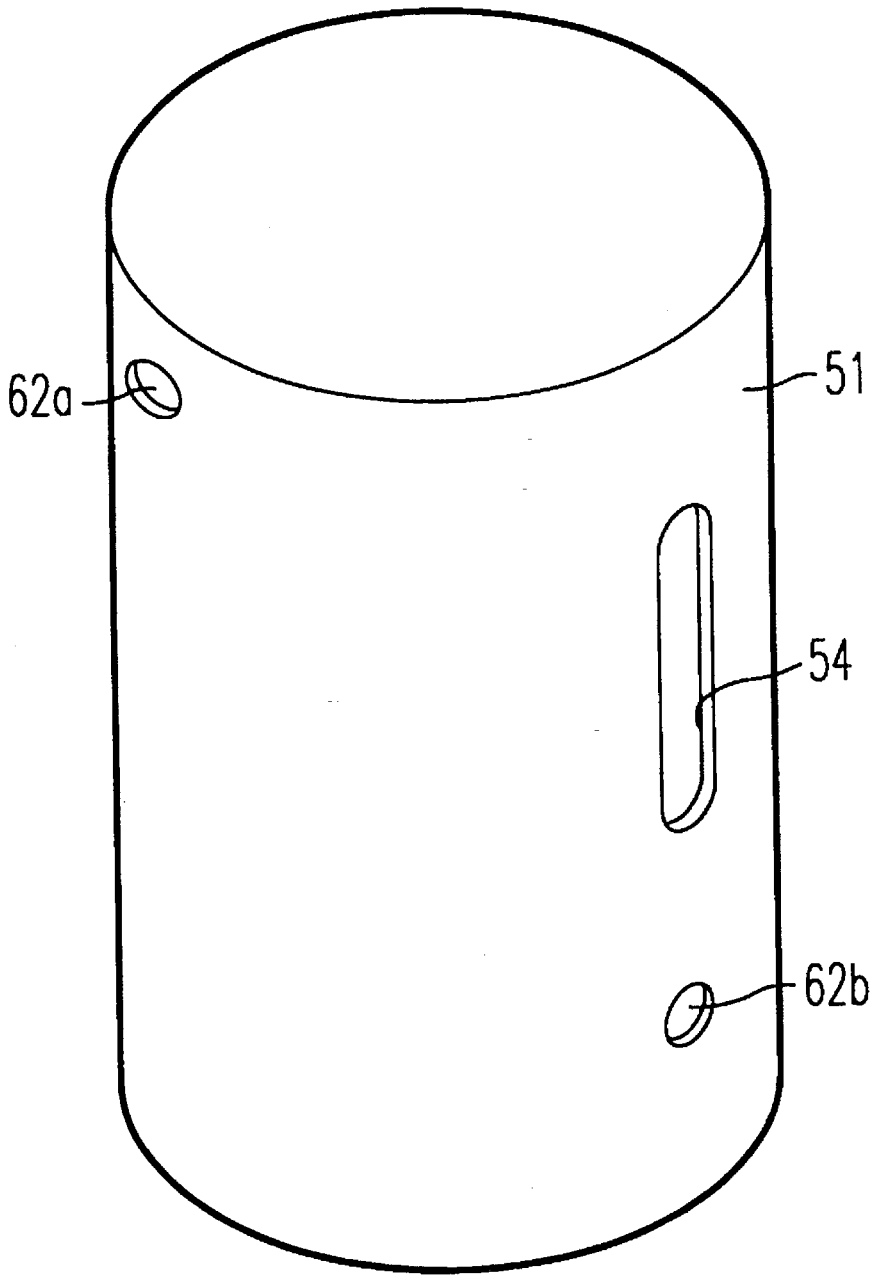
FIG. 9 is a general perspective view of the water cylinder showing one form of each of the outlet communication opening and the air intake communication openings

Referring to FIGS. 3 to 9, one embodiment of the cylinder for the pumping machine according to the present invention will be described below. FIG. 3 is a vertical sectional view of one embodiment of the cylinder for the pumping machine according to the present invention, in which valve members of the water cylinder are at the bottom dead centers. FIG. 4 is a vertical sectional view of the embodiment of the cylinder for the pumping machine according to the present invention, in which the valve members of the water cylinder have somewhat ascended from the bottom dead centers. FIG. 5 is a vertical sectional view of the embodiment of the cylinder for the pumping machine according to the present invention, in which the valve members of the water cylinder are at the top dead centers. FIG. 6 is a vertical sectional view of the embodiment of the cylinder for the pumping machine according to the present invention, in which the valve members of the water cylinder have somewhat descended from the top dead centers. FIG. 7 is a perspective view generally showing one mode of distribution of check valves in a disc member to which check valves are to be attached. FIG. 8 is a perspective view generally showing one form of the check valve used for the cylinder for the pumping machine as shown in FIG. 3. FIG. 9 is a general perspective view of the water cylinder showing one form of each of the outlet communication opening and the air intake communication openings.

This cylinder for the pumping machine corresponds to the cylinder S of the pumping machine previously shown in FIG. 1, and is composed mainly of a main cylinder 50 as a cylinder body, a water cylinder 51 as a hollow cylinder member fitted in the main cylinder 50, an air cylinder 6 as a cylinder member located in the water cylinder 51, an air piston 5 as a piston member contained in the air cylinder 6, and valve means 12,15 located in the water cylinder 51.

The main cylinder 50 in this embodiment is formed to be a hollow cylinder, and therein, the water cylinder 51 is fitted slidably in the longitudinal direction (the vertical direction in FIG. 3). About the middle of the length of the main cylinder 50 is formed an outlet 20 as a first communication opening to enable a pumped-water pipe 21 to be connected thereto. Further, the outlet 20 is in communication with a central chamber 51*a* via an outlet communication opening 54 (described below). Moreover, in the vicinities of both ends of the main cylinder 50, air intake openings 62*a* and 62*b* are formed to enable air intake pipes 45 and 45' to be connected thereto, respectively. The air intake openings 62*a* and 62 *b* are formed at the midpoints of the strokes L of the valve means 12 and 15 described below, respectively. In other words, each of them is formed at the point about L/2 distant from the respective end of the main cylinder 50.

The air cylinder 6 contains therein the air piston 5 formed to be a disc, and the interior of the air cylinder 6 is divided by the air piston 5 into the first cylinder chamber 6*a* and the second cylinder chamber 6*b*. In the vicinities of both ends of the air cylinder 6, ports for compressed air 52*a* and 52*b* are formed, and compressed air pipes (not shown) are connected thereto. A piston rod 5*a* about which the air piston 5 is fixed extends through both the end surfaces of the air cylinder 6, and O-rings 53 are provided around the pierced portions to maintain the sealed condition in the air cylinder.

The air piston 5 is formed to be a disc and inserted in the air cylinder 6 slidably in the longitudinal direction (the vertical direction in FIG. 3) of the air cylinder 6. Through the center portion of the air piston 5 extends the piston rod 5*a*, and they are fixed to each other. The ends of the piston rod 5*a* are fixedly attached to the valve means 12 and 15.

The water cylinder 51 is fitted in the main cylinder 50 slidably in the longitudinal direction of the main cylinder 50, and accordingly, has a configuration of a hollow cylinder in conformity with the main cylinder 50. The end portions of the water cylinder 51 are provided with valve means 12 and 15.

In the water cylinder 51, a communication opening 54 which is in communication with the previously described outlet 20 of the main cylinder 50 is formed, for example, as an elongate hole in the longitudinal direction of the water cylinder 51, as shown in FIG. 9 (Incidentally, the valve means 12 and 15 are omitted in FIG. 9.)

Each of the valve means 12 and 15 at the ends of the water cylinder 51 has a double structure. In other words, each of the valve means 12 and 15 at the ends of the water cylinder 51 of this embodiment comprises disc members disposed in series with a predetermined distance, and a plurality of check valves arranged in the disc members. The arrangement of the check valves in this embodiment is such that the check valves 55 are arranged on two concentric circles around the central through-hole 56 through which the piston rod 5*a* extends, six of the check valves 55 being arranged on the inner concentric circle and eight of the check valves 55 being arranged on the outer concentric circle, as shown in FIG. 7.

The check valve 55 comprises, as shown in FIG. 8, an annular mounting member 57, a passage window 58 fitted into the center hole of the annular mounting member 57, a bolt 59 having its one end fastened to the center of the passage window 58 with a nut, a spring 60 mounted between the other end of the bolt 59 and passage window 59, and a disc-shaped valve element 61 covering the passage window 58 and disposed between the spring 60 and the passage window 58.

As shown in FIG. 9, the water cylinder 51 is also formed with air intake communication openings 62*a* and 62*b* as second and third communication openings which are in communication with the air intakes 45 and 45' of the main cylinder 50, respectively.

In view of the structure of the check valve, when a fluid flows upon the valve element 61 from the side of the check valve on which the valve element 61 is disposed [the side shown in FIG. 8(*a*)], the valve element 61 is pressed against the passage window 58 by the pressure of the fluid to obstruct the passage window 58, thereby preventing the fluid from flowing into the reverse side through the passage window 58. On the other hand, when a fluid flows upon the valve element 61 through the passage window 58 from the side of the check valve reverse to the side on which the valve element 61 is disposed [the side shown in FIG. 8(*b*)], the valve element 61 is caused to move in the axial direction of the bolt 59 [the direction shown by the solid line arrow in FIG. 8(*a*)] by the pressure of the fluid against the biasing force of the spring 60, thereby allowing the fluid to flow into the other side through the passage window 58. When the pressure of the fluid is surpassed by the biasing force of the spring 60, the valve element 61 is again pressed against the passage window 58 by the biasing force, thereby leading to closed condition of the check valve. The bolts 59 and associated nuts permit the biasing force of the spring 60 on the check valves 55 in the outer disk of the valve members 12 and 15 to be set so that those valves remain closed even though there is a partial vacuum in the cylinder 11 or 13 while permitting water and air to briefly flow through the check valves 55 in the inner disk of the valve member 12 or 15 as more fully described hereinafter.

Then, operation of the cylinder having the above-described structure will be described with reference to FIG. 1 and FIGS. 3 to 6.

FIG. 3 shows the cylinder in which the air piston 5 is at the most lowered position, namely, the bottom dead center. The air piston 5 is associated with the valve members 12,15, and accordingly, when the air piston 5 is at its bottom dead center, the valve members 12,15 are at their bottom dead center.

Upon arrival of the air piston 5 at the bottom dead center, air flow is switched over by the action of the selector valve 1 (see FIG. 1) to start introduction of compressed air from the other port 52*b* of the air cylinder 6, and accordingly, the air piston 5 begins to ascend.

The valve members 12,15 begin to ascend concurrently with the start of the ascent of the air piston 5, thereby causing water in a water storage reservoir (see FIG. 1) to flow into the cylinder 11 through the upper check valves 55 of the valve member 12 to compress the air in cylinder 11 and force a mixture of air and water through cylinder 11 into the chamber 51*a* through the lower check valves 55 of the valve member 12. The ascending motion of the valve means 15 and the inflow of water and air into chamber 51*a* through the lower check valves 55 of valve member 12 compresses the air in chamber 51*a* and discharges a mixture of compressed air and water from outlet 20 through pumped-water pipe 21 into a service water storage tank 22.

Upon arrival of the valve member 12 at the top dead center (see FIG. 5), the air flow is again switched over by the action of the selector valve 1 to start introduction of compressed air from the other port 52*a* of the air cylinder 6, and accordingly, the valve members 12,15 begins to descend in association with the start of the descent of the air piston 5. When the valve member 12 passes through its top dead center position (FIG. 5) and begins its downward movement, the upper check valves 55 of the valve member 12 close while the momentum of the water and air mixtures continues the flow of water and air briefly through the lower check valves 55 of the valve member 12. That continued flow out of the cylinder 11 creates a negative pressure in cylinder 11 which causes air to be drawn into the cylinder 11 through air pipe 45 and opening 62*a*. The arrows shown in FIGS. 3–6 depict the flow of water and air into and out of chamber 51*a*. As the cylinder 51 passes through the top dead center position, air is caused to flow into the cylinder 11 in a predetermined amount, and then the air intake opening 62*a* ceases to communicate with the air intake pipe 45 thereby terminating the introduction of air into the cylinder 11. During the downward movement of the cylinder 51, water is caused to flow into chamber 51*a* from the cylinder 13 through the check valves 55. Thus, water in chamber 51*a* is discharged through outlet 20. In parallel with this, however, chamber 51*a* becomes under positive pressure increased depending upon the diameter of the pipe 20. Accordingly, water coexistent with air as a mixture in chamber 51*a* is pressurized. Consequently, in the course of downward movement of the cylinder 51 to its bottom dead center position, the air is more and more compressed and reduced in volume (air has far greater compressibility than water). Concomitantly, the total volume of water and the air coexistent therewith is reduced, thus, the water coexistent with air introduced into chamber 51*a* is partly discharged and the rest is pressurized.

Then, as the cylinder 51 passes through its bottom dead center position, negative pressure is momentarily created in cylinder 13 (in particular, in the lower portion thereof). Consequently, air is caused to flow into cylinder 13 of the cylinder 51 from the air supply pipe 45' which is, at that time, in communication with cylinder 13 via the air intake communication opening 62*b*. The pipe 45' is provided with a check valve 19 for preventing the backflow of air and water.

During the transition of the cylinder 51 through its bottom dead center position, air is caused to flow into cylinder 13 in a predetermined amount, and then the air intake communication opening 62*b* ceases to communicate with the air intake pipe 45' thereby terminating the introduction of air. During the upward movement of the cylinder 51, water is caused to flow into chamber 51*a* from the upper cylinder 11 through check valves 55. Thus, the water coexistent with the compressed air in chamber 51 is discharged through outlet 20. At that time, the air is released from the compression force to expand, thereby enabling extremely efficient pumping of water to be realized.

In the above embodiment, each of the valve members 12,15 is provided with 14 check valves 55. However, the number of the check valve 55 is not necessarily restricted to this number. It is of course possible to select any convenient number of the check valve.

Figure 11:
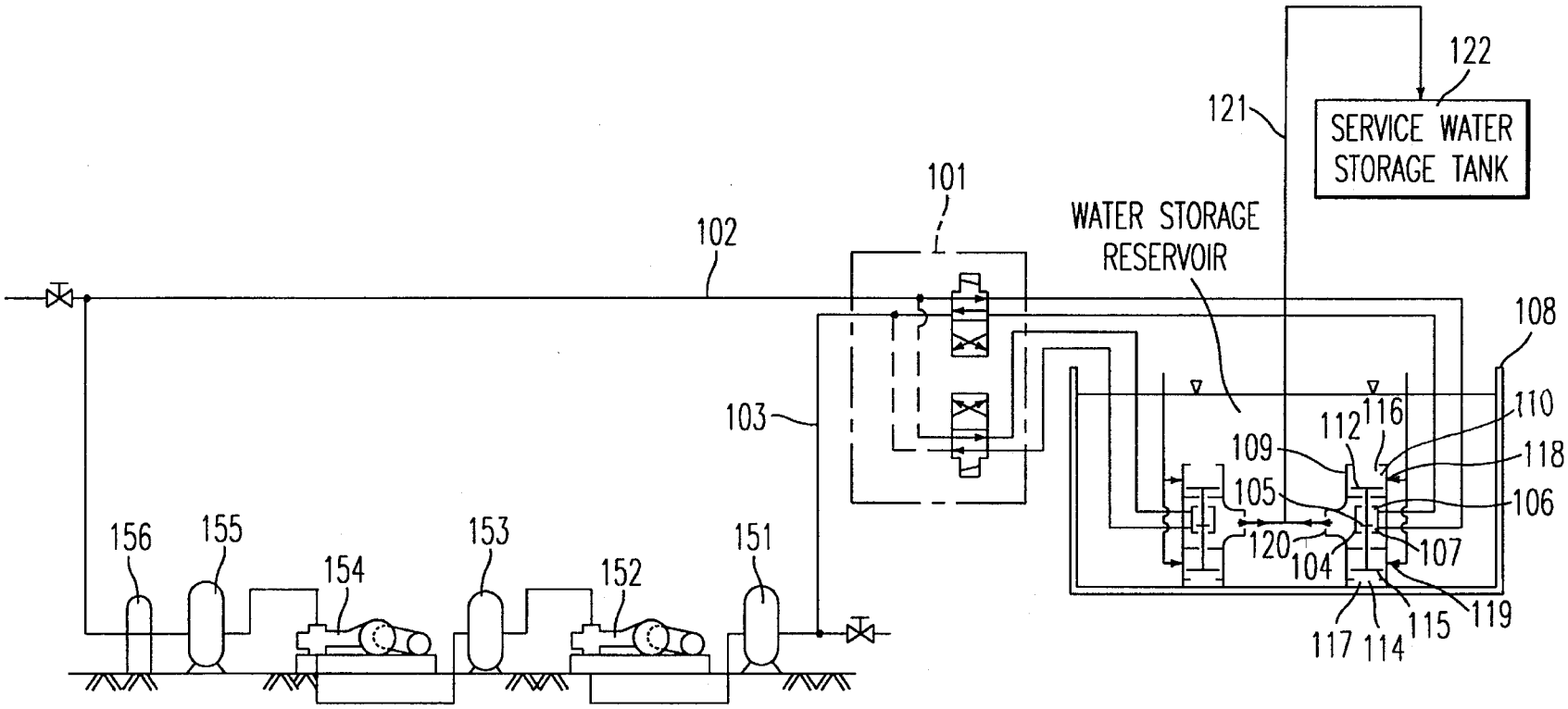
FIG. 11 shows a pumping machine utilizing the booster circuit for compressing air according to the present invention.

FIG. 11 shows the pumping machine utilizing a booster circuit for compressing air according to the present invention. Although this Fig. shows two pumping machines each comprising an air cylinder 104 and a water cylinder 109 are symmetrically disposed in a water storage reservoir 108 in parallel, description will be made hereinafter with respect only to one of them for the convenience of explanation.

Reference numeral 101 represents an air flow selector valve, and two 4 port connection-2 position electromagnetic selector valves (so-called 4 port connection valves) are used. Reference numeral 102 represents a supply pipe for compressed-air, and reference numeral 103 represents a return pipe for compressed-air with residual pressure.

At the central portion of the pumping machine uprightly installed in water, an air cylinder 104 is located. The air cylinder 104 is divided into two pressure chambers 106,107 by a piston 105. The air cylinder 104 is surrounded by a substantially concentric water cylinder 109, and water pistons 112,115 (i.e., valve members of the type described above with respect to FIGS. 3–6) having a diameter larger than that of the piston 105 are concentrically mounted on upper and lower ends of a piston rod vertically extending through the piston 105, respectively. Reference numerals 118 and 119 represent check valves which preclude the backflow of air and water through the air intake pipes illustrated in FIG. 11.

Figure 10:
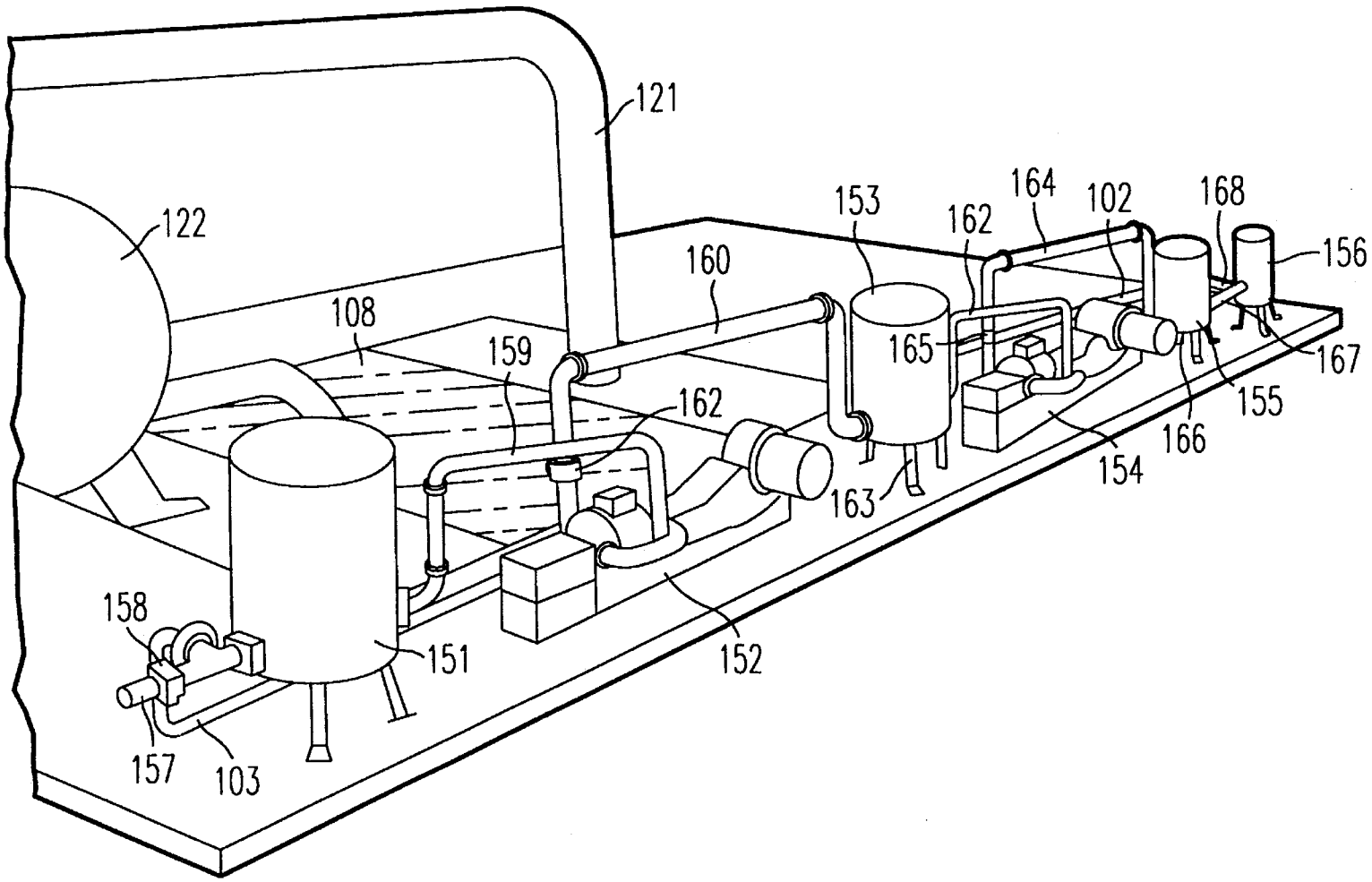
FIG. 10 is a perspective view of a booster circuit for compressing air according to the present invention.

THe embodiment of the compressed air booster according to the present invention which is used for the pumping machine having such a construction comprises a low pressure tank 151, a first boosting compressor 152, an intermediate pressure tank 153, a second boosting compressor 154, a high pressure tank 155, and a receiver tank 156 which are connected to the return pipe for the compressed air having residual pressure in parallel, as shown in FIG. 10. The returned air is boosted by means of the two two-stage reciprocating compressors of installation type and supplied to the compressed air supply pipe 102 connected thereto. In other words, the return pipe 103 (made of a steel) is connected to an external air introducing pipe 157 (made of a steel) at a point just before the low pressure tank 151 (made of a steel), the confluence pipe is connected to the inlet of the low pressure tank 151. The external air introducing pipe 157 is provided with a control valve 158 which is closable for the time when only the compressed air having residual pressure is intended to be supplied from the return pipe 103.

The low pressure tank 151 has a capacity of 0.9 $m^3$ to ensure the amount of air to be drawn into the first boosting compressor 152. A connecting pipe 159 (made of a steel) from the outlet of the low pressure tank 151 to the inlet valve of the first boosting compressor 152 runs once upwardly, then horizontally and then downwardly to the inlet valve.

As the first boosting compressor 152 provided with a view mainly to sucking a required amount of air from the low pressure tank 151, there is used a reciprocating compressor of a two-stage horizontal type (double acting type) with a rated capacity of 12 $m^3$/min, an inlet pressure larger than atmospheric pressure (positive pressure), an outlet pressure of 22 $m^3$/min, a rated speed of 1,500 rpm., and motor power consumption of 7 kw.

The capacity of the compressor is selected by first determining the total air volume from the air flow in the air cylinder 104 of the pumping machine and the supply and return pipes 102,103 and a margin air volume, and determining the delivery air volume from the product of the displacement of the piston compressor and a volumetric efficiency, followed by comparison between the determined values. In the case of the present invention, appropriate capacities are allotted to the first and second boosting compressors based on these values.

A connection pipe 160 (made of a steel) connected to the outlet valve of the first boosting compressor 152 runs upwardly via a control valve 161, then horizontally and then downwardly to the inlet of the intermediate pressure tank 153 (made of a steel).

The intermediate pressure tank 153 is used to temporarily store compressed air for prevention of abrupt change in the pressure, and yet, it serves to reduce pulses of the compressed air discharged from the first boosting compressor 152, and when the air is caused to flow intermittently, it serves to prevent the pressure from lowering at the time of occurrence of air flow in a large amount by supplying compressed air in compensation therefor.

The capacity of the intermediate pressure tank 153 is determined by the delivery air volume from the first boosting compressor 152, the air consumption in the air cylinder 104 of the pumping machine and the supply and return pipes, the maximum pressure in the intermediate pressure tank 153, the allowable minimum pressure in the intermediate pressure tank 153, operation time per minute of the air cylinder 104 and the like. In this embodiment, the capacity is 28 $m^3$/min.

The intermediate pressure tank 153 is provided with a drain cock 163 to discharge stagnant drain, oil and the like from the bottom of the tank 153 to the outside.

A connection pipe 162 (made of a steel) from the outlet of the intermediate pressure tank 153 to the inlet valve of the second boosting compressor 154 runs once upwardly, then horizontally and then downwardly to the inlet valve.

The second boosting compressor 154 is provided with a view to pressurizing the compressed air having the intermediate pressure to a predetermined pressure. As the second boosting compressor 154, also used is a reciprocating compressor of a two-stage horizontal type (double acting type) with a rated capacity of 20 horsepower, an inlet pressure of 22 $m^3$/min, an outlet pressure of 12 kg/$cm^2$, a rated speed of 1,800 rpm., and motor power consumption of 20 kw. The capacity of the second boosting compressor is selected by allocation between this compressor and the first boosting compressor 152.

A connection pipe 164 (made of a steel) connected to the outlet valve of the second boosting compressor 154 runs upwardly via a control valve 165, then horizontally and then downwardly to the inlet of the high pressure tank 155 (made of a steel). Besides the control valves 161 and 165, the pipes 160 and 164 may be provided with check valves to prevent back-flows from the intermediate pressure tank 153 to the first boosting compressor 152 and from the high pressure tank 155 to the second boosting compressor 154 respectively. However, the outlet valves of the boosting compressor generally serve therefor.

The high pressure tank 155 is also used to temporarily store compressed air for prevention of abrupt change in the pressure, and yet, it serves to reduce pulses of the compressed air discharged from the second boosting compressor 154, and when the air is consumed intermittently, it serves to prevent the pressure from lowering at the time of occurrence of air consumption in a large amount by supplying compressed air in compensation therefor.

The capacity of the high pressure tank 155 is determined in the same manner as described for the capacity of the intermediate pressure tank 153. In this embodiment, the capacity is 6.25 $m^3$.

The high pressure tank 155 is also provided with a drain cock 166 to discharge stagnant drain, oil and the like from the bottom of the tank 155 to the outside.

A connection pipe 167 from the outlet of the high pressure tank 155 to the inlet of the receiver tank 156 runs straight and horizontally. The receiver tank 156 serves as a relay tank. A pipe 168 (made of a steel) extending from the outlet of the receiver tank 156 is connected to the compressed air supply pipe 102 (made of a steel).

Then, operation of the pumping machine using the compressed air booster according to the present invention will be described in terms mainly of the air flow.

The air flow selector valve 1 directs compressed air having a pressure of about 12 kg/$cm^2$ G from the supply pipe 102 toward one pressure chamber 106 to move the air piston 105. On the other hand, air in the other pressure chamber 107 of the air cylinder 104 is pushed out therefrom by the air piston 5 and, while retaining residual pressure of about 5 to 7 kg/$cm^2$ G, sent back to the selector valve 101 and returned through the return pipe 103 to the low pressure tank 151.

The thus returned compressed air with a residual pressure of about 5 to 6 kg/$cm^2$ G is boosted through the low pressure tank 151 and the first boosting compressor 152 to a pressure of about 8 kg/$cm^2$ G and through the intermediate tank 153 and the second boosting compressor 154 to a pressure of about 12 kg/$cm^2$ G, and stored in the high pressure tank 155, and directed again to the selector valve 101 via the receiver tank 156 and through the supply pipe 102. The selector valve 101 changes air flow after lapse of a predetermined time interval, and directs the compressed air having a pressure of about 12 kg/$cm^2$ G toward the other pressure chamber 107 of the air cylinder 104 to move the air piston 105 to one pressure chamber 106 of the air cylinder104. Consequently, the air in one pressure chamber 106 of the air cylinder 104 is pushed out therefrom by the air piston 105 and, while retaining a residual pressure of about 5 to 6 kg/$cm^2$ G, returned through the return pipe 103 to the low pressure tank 151. The reciprocating motion of the air piston 105 in this manner is repeated.

Thus, the compressed air is circulated through the air cycle in the above-mentioned circulatory course, and thereby the piston 105 is caused to move. In this case, the initial pressure of about 12 kg/$cm^2$ G of the compressed air is consumed in the reciprocating motion of the air piston 105, and the compressed air is returned as a compressed air having a residual pressure of about 5 to 6 kg/$cm^2$ G. The compressed air booster according to this embodiment is used to re-pressurize the compressed air with residual pressure of about 5 to 6 kg/$cm^2$ G which has heretofore been discharged into the atmosphere to a high pressure, thereby enabling energy saving effect in water pumping-up to be enhanced.

Now, the operation of the compressed air booster according to the present invention will be described further in detail.

The compressed air with a residual pressure of about 5 to 6 kg/$cm^2$ G returned from the return pipe 103 is stored in the low pressure tank 151 under the same pressure. By operation of the first boosting compressor 152, the compressed air stored in the low pressure tank 151 is drawn into the inlet of the first boosting compressor 152 through the pipe 159 and boosted to a pressure of about 8 kg/$cm^2$ G.

The air boosted to a pressure of about 8 kg/$cm^2$ G in the first boosting compressor 152 is discharged from the outlet of the first boosting compressor 152, and pneumatically directed through the pipe 160 via the control valve 161 to the intermediate pressure tank 153, and stored therein at the predetermined pressure level of about 8 kg/$cm^2$ G. The intermediate pressure tank 153 serves to prevent abrupt change in the pressure and to reduce pulses of the compressed air discharged from the first boosting compressor 152.

The compressed air with the predetermined pressure stored in the intermediate pressure tank 153 is drawn into the inlet valve of the second boosting compressor 154 through the pipe 162 and further boosted therein to a pressure of about 12 kg/$cm^2$ G. It is noted that two two-stage reciprocating compressors are used here in series. This is because it is undesirably power consuming, i.e., poor in energy efficiency to boost the compressed air to the predetermined final pressure by means of one-stage reciprocating compressors. In other words, when number of the stage is increased, air after completion of the first stage boost is cooled by an intermediate cooling device to the ambient temperature, and from this condition, the second stage boost can be started. Consequently, power consumption is reduced to attain improved energy efficiency. However, use of one multi-stage reciprocating compressor having a large capacity leads to high initial cost. Therefore, the two two-stage reciprocating compressors are disposed in parallel. Practically, the air is boosted from a positive pressure to about 8 kg/cm$^2$ G in the first boosting compressor 152, and from about 8 kg/cm$^2$ G to about 12 kg/cm$^2$ G in the second boosting compressor 154.

The air which has been subjected to the second stage compression in the second boosting compressor 154 is discharged from the outlet valve of the second boosting compressor 154, and pneumatically directed through the pipe 164 via the control valve 165 to the high pressure tank 155, and stored therein at the predetermined pressure level. The high pressure tank 155 also serves to prevent abrupt change in the pressure and to reduce pulses of the compressed air discharged from the second boosting compressor 154. The compressed air with the predetermined pressure which is stored in the high pressure tank 155 is directed through the pipe 167 to the receiver tank 156 as a relay tank, and then directed from the receiver tank 156 through the pipe 168 to the compressed air supply pipe 102.

In the next place, a water channel will be described.

The water storage reservoir 108 has a depth of about 7 m. The air piston 105 of the air cylinder 104 is associated with the water pistons 112 and 115 in the water cylinder 109. When the piston 105 is pushed downwardly by supplying the compressed air to one pressure chamber 106 of the air cylinder 104, the water pistons 112 and 115 are also pushed down concurrently. The size, stroke, and operation of the water pistons, i.e., valve members, 112 and 115 are the same as the size, stroke, and operation described above with respect to the water pistons, i.e., valve members 12 and 15, shown in FIGS. 3 to 6.

In this embodiment, there are arranged in parallel the two pumping machines each comprising the air cylinder 104 having the air piston 105 and the water cylinder 109 the two water pistons 112 and 115 which move in association with the piston 105. However, there may be used (a) pumping machine(s) in which a single water piston associated with a piston 105 is caused to vertically reciprocate attendantly upon movement of the piston 105 to take in water and to introduce air and the water is pumped up utilizing force of the compressed air. Further, besides the use of the two pumping machines in parallel, a single pumping machine may be used or three or more pumping machines may be used in parallel. Of these arrangements, those in which pumping machines are arranged in parallel and/or in which two water pistons are associated with a piston are preferred. The reason for this is that more smooth operation in pumping up water is enabled due to reduced number of times of air compression in spite of somewhat complicated valve control.

Incidentally, in the embodiment of the compressed air booster for the pumping machine of the present invention, the two two-stage reciprocating compressors are used in series. However, combinations of one-stage and two-stage compressors, one-stage and three-stage compressors, one-stage and four-stage compressors, and the like may be employed.

The pumping machine comprising the compressed air booster for the pumping machine according to the present invention may be used in the above-mentioned power generator system.

FIG. 12 is a diagrammatic view schematically showing power generation mechanism utilizing such a pumping machine.

In the power generator system, an accumulator tank 132 (high pressure tank) stores up compressed air from boosting compressors 172,174. The boosting compressors 172,174 are operated with commercial power. Reference numeral 133 represents an air receiver (relay tank), which transfers the compressed air from the accumulator tank 132 to a selector valves 134,134'. Reference numeral 171 represents a low pressure tank and reference numeral 173 represents an intermediate pressure tank, both of which store the compressed air.

In the power generator system according to this embodiment, 4 port connection-2 position rotary selector valve are used, and a KS type motor of 0.75 kw is used as a power for each of the selector valves 134,134'. The selector valves 134,134' are so constructed that air with a residual pressure from a return pipe 176 is caused to flow into a a booster circuit 177 and boosted through the low pressure tank 171, the first boosting compressor 172, the intermediate pressure tank 173 and the second boosting compressor 174 in the booster circuit 177 so as to pneumatically force itself to enter into the accumulator tank 132 (high pressure tank). In this embodiment, each of the two rotary selector valves 134 and 134' is used to deliver and to receive the compressed air, thereby effecting switchover between delivery and reception of the compressed air.

By the switchover between delivery and reception of the compressed air by means of the valves 134,134', pistons in air cylinders of the pumping machines 135, 135', 136, and 136' are alternately caused to reciprocate. In association with the movement of the pistons in the air cylinders, water pistons in water cylinders of the pumping machines are caused to reciprocate to pump up water in the water cylinders together with air which has been sucked therein to a service water storage tank 137. The pumped water is stored in the service water storage tank 137 and then released therefrom to drive a water turbine 138 by utilizing a head of the water, thereby operating a power generator 139 to obtain a predetermined generated energy.

Further, since the pumping equipment is satisfactorily performable so long as it is disposed under a predetermined water pressure, it may be used, for example, in a driving means of a ship by disposing miniaturized one to form a generator, leading to extremely wide variety of applications.

According to the present invention, there is provided a compressed air boosting compressor for the pumping machine used in the power generator system, which comprises as an air pressure source connected to said return pipe in series:

a low pressure tank for storing air with a residual pressure, a first boosting compressor for sucking the air with a residual pressure from said low pressure tank, an intermediate pressure tank for storing the compressed air discharged from said first boosting compressor and for preventing abrupt change in the pressure, a second boosting compressor for boosting the compressed air with an intermediate pressure from said intermediate pressure tank to a predetermined pressure, a high pressure tank for storing the compressed air discharged from said second boosting compressor and for preventing abrupt change in the pressure, and a receiver tank which is connected to said supply pipe for relaying the compressed air from said high pressure tank to said supply pipe;

each of said first and second boosting compressors being selected from the group consisting of one-stage to multi-stage reciprocating compressors.

Accordingly, each of the first and second boosting compressors may be selected from reciprocating compressors with any number of stages. Further, since the boosting compressors are disposed in series, power consumption is reduced, and yet, those having small number of stage(s) may be used, thereby enabling lower initial cost to be attained as compared with use of one multi-stage reciprocating compressor having a large capacity. Moreover, the compressed air still retaining a residual pressure (positive pressure) can be used as air to be compressed to a predetermined pressure (about 5 kg/cm$^2$ G). This leads to energy saving and is waste free, as compared with use of external air which has no additional pressure. Furthermore, by utilizing this boosting compressor, highly efficient pumping machines and power generator systems are realized.

What is claimed is:

1. A pumping machine disposed under a predetermined water pressure and comprising:

an air cylinder including a piston which reciprocates by switch over between delivery and reception of compressed air, a water cylinder including a valve member comprising a cylinder within said water cylinder, said water cylinder reciprocating in association with the movement of said piston of said air cylinder, an air intake opening formed in said valve member for introducing external air into said valve member by the reciprocating motion of said water cylinder, an air intake pipe, said air intake opening in said valve member communicating with said air intake pipe when said water cylinder is in its top dead center position, an upper disc forming one end of said valve member and a lower disc forming an other end of said valve member, a first check valve structure in said upper disc for admitting water under a predetermined pressure into said valve member when said water cylinder is moving toward its top dead center position by precluding flow through said upper disc when said water cylinder is moving in the opposite direction, a chamber in said water cylinder adjacent said lower disc, a second check valve structure in said lower disc permitting an air and water mixture in said valve member to flow into said chamber when said water cylinder is moving toward its top dead center position but precluding flow when said water cylinder is moving in the opposite direction, said reciprocating motion of said water cylinder creating a negative pressure in said valve member when said water cylinder is in its top dead center position whereby air is drawn into said valve member through said air intake opening and said air pipe, a third check valve structure in said air pipe permitting the flow of air into said valve member but precluding flow in the opposite direction, an outlet for discharging the mixture of water with air in said chamber by the reciprocating motion of said water cylinder.

2. The pumping machine according to claim 1, wherein the switchover between deliver and reception of compressed air is conducted by switching a four port connection valve at predetermined intervals.

3. The pumping machine according to claim 1, wherein said water cylinder includes two valve members which are simultaneously caused to reciprocate.

4. A cylinder for the pumping machine comprising:

a cylindrical hollow body formed with a first through-hole at its mid portion and second and third through-holes in the vicinities of its ends, a cylindrical hollow member which is fitted in said cylindrical body, slidable longitudinally within the cylindrical body, formed with a communication opening which is in communication with the first through-hole, and having opposite ends, valve members mounted on the ends of said cylindrical member, a cylinder member which is contained in said cylindrical member and which has ports in the vicinities of its ends, and a piston member which is slidably disposed in said cylinder member and which has a rod extending through said cylinder member and having its ends fixedly connected to said valve members;

wherein said valve members each include two discs to define a cylinder chamber having a communication opening in communication with said second or third through-hole, said discs each having a plurality of check valves arranged therein, said check valves each being mounted to permit a fluid to flow only in the direction toward the inner portion of said cylinder member.

5. A generator system comprising:

a selector valve for a switchover between delivery and reception of compressed air, a pumping machine disposed under a predetermined water level, said pumping machine comprising an air cylinder including a piston and a valve member, said piston being caused to reciprocate in said air cylinder by the switchover between delivery and reception of compressed air to reciprocate said valve member in association with movement of said piston, said valve member including an air intake opening for effecting suction of external air into said valve member, first check valve structure for permitting water under a predetermined water pressure to flow into said valve member in one direction of reciprocation of said valve member, and second check valve structure for permitting a flow of a mixture of air and water out of said valve member in said one direction of reciprocation, third check valve structure precluding flow out of said valve member through said air intake opening, a service water storage tank for storage of pumped water, a water turbine which is rotated by utilizing a head of water released from said service water storage tank, and a power generator which is caused to operate in association with said water turbine.

6. The generator system according to claim 5, wherein the air cylinder is connected to an accumulator tank and an air receiver for delivery of the compressed air, said accumulator tank and said air receiver being disposed under said predetermined water level.

7. The generator system according to claim 5, wherein said pumping machine further comprises:

a compressed air supply pipe and a compressed air return pipe, said piston being reciprocated by switchover between delivery of compressed air to said compressed air supply pipe and reception of compressed air from said compressed air return pipe, a water cylinder including said valve member, said valve member including a water piston which is located coaxially with said piston of said air cylinder and reciprocates in association with the movement of said piston of said air cylinder, said air intake opening formed in said valve member introducing external air through said valve member into water in a cylinder chamber of said water cylinder in response to negative pressure generated in said valve member in the course of the reciprocating motion of said water piston, and an outlet for discharging the mixture of water with air in said cylinder chamber, which has been compressed to a predetermined pressure, by the reciprocating motion of said water piston.

8. A compressed air boosting compressor for the pumping machine used in the power generator system according to claim 7, which comprises as an air pressure source connected to said return pipe in series:

a low pressure tank for storing air with a residual pressure, a first boosting compressor for sucking the air with a residual pressure from said low pressure tank, an intermediate pressure tank for storing the compressed air discharged from said first boosting compressor and for preventing abrupt change in the pressure, a second boosting compressor for boosting the compressed air with an intermediate pressure from said intermediate pressure tank to a predetermined pressure, a high pressure tank for storing the compressed air discharged from said second boosting compressor and for preventing abrupt change in the pressure, and a receiver tank which is connected to said supply pipe for relaying the compressed air from said high pressure tank to said supply pipe;

each of said first and second boosting compressors being selected from the group consisting of one-stage to multi-stage reciprocating compressors.

9. The compressed air booster for the pumping machine according to claim 8, wherein each of said first and second boosting compressors is a two-stage reciprocating compressor.

* * * * *